US006128181A

United States Patent [19]

Higami et al.

[11] Patent Number: 6,128,181

[45] Date of Patent: Oct. 3, 2000

[54] ELECTRIC COMPONENT UNIT

[75] Inventors: Motoharu Higami; Koji Ito, both of Toyama Pref., Japan

[73] Assignee: Hokuriku Electric Industry Co., Ltd., Toyamo Pref., Japan

[21] Appl. No.: 09/419,528

[22] Filed: Oct. 18, 1999

[30] Foreign Application Priority Data

Oct. 19, 1998 [JP] Japan ..... 10-296851

[51] Int. Cl.[7] ..... H01R 9/00; H01K 5/00

[52] U.S. Cl. ..... 361/600; 361/600; 361/752; 361/753; 361/796; 361/799; 361/823; 174/252; 439/34; 439/377; 439/157; 439/160; 439/851; 439/876; 439/440; 439/441

[58] Field of Search ..... 361/600, 752, 361/753, 759, 754, 796, 799, 800, 823, 836; 439/34, 377, 440, 493, 495, 108–109, 441, 857, 67, 77, 61, 157–160, 851, 876; 174/252, 15.1, 16.3, 50 R

[56] References Cited

U.S. PATENT DOCUMENTS

| | | | |
|---|---|---|---|
| 5,546,280 | 8/1996 | Hasebe et al. . | |
| 5,579,213 | 11/1996 | Hasebe et al. | 361/823 |
| 6,012,944 | 1/2000 | Hatakeyama | 439/441 |

FOREIGN PATENT DOCUMENTS

| | | | |
|---|---|---|---|
| 407235402 | 9/1995 | Japan | H01C 01/14 |
| 409063814 | 3/1997 | Japan | H01C 13/00 |
| 10189316 | 7/1998 | Japan . | |

*Primary Examiner*—Leo P. Picard
*Assistant Examiner*—Michael Datskovsky
*Attorney, Agent, or Firm*—Rankin, Hill, Porter & Clark LLP

[57] ABSTRACT

An electric component unit capable of keeping an operator from feeling a difference in force required for inserting a connection conductor into an electric component unit during insertion of plural connection conductors different in diameter. A terminal fitment includes a conductor holding section provided with four holding elements. Two of the holding elements are so arranged that distal portions thereof are opposite to each other with an end of the connection conductor being interposed therebetween and contacted with the end of the connection conductor. The remaining two of the holding elements are so arranged that distal portions thereof are positioned forwardly or rearwardly in a longitudinal direction of the connection conductor based on a position at which the two holding elements are contacted with the end of the connection conductor while being contacted with the end of the connection conductor and interposing the end of the connection conductor therebetween.

10 Claims, 3 Drawing Sheets

ELECTRIC COMPONENT UNIT

BACKGROUND OF THE INVENTION

This invention relates to an electric component unit, and more particularly to an electric component unit including a terminal fitment which permits connection of a connection conductor to an electric component without soldering.

Use of flon is subject to restriction in view of environmental pollution, so that it Is highly required to connect a terminal conductor, a lead wire or the like to a connection electrode on a circuit board without soldering.

U.S. Pat. No. 5,546,280 (corresponding to Japanese Patent Application No. 318669/1994) issued to the assignee discloses two kinds of soldering-less terminal connection structures each constructed so as to connect a core of a lead wire to a connection electrode on a circuit board without soldering.

Also, the U.S. patent discloses a connection structure including a terminal fitment integrally provided with a conductor holding section and an elastic contact terminal section. The terminal fitment is so constructed that the elastic contact terminal section connects the conductor holding section to an electrode on a circuit board without soldering. Further, the U.S. patent discloses a structure for connecting a plurality of electrodes on a circuit board and a plurality of connection conductors to each other without soldering.

In addition, Japanese Patent Application Laid-Open Publication No. 189316/1998 (Japanese Patent Application No. 350137/1996) discloses a soldering-less connection structure wherein a terminal assembly includes a terminal fitment provided with two conductor holding sections and a conductive coiled spring arranged between the terminal fitment and an electrode on a circuit board.

The conventional terminal fitments described above each include four holding elements (divided elements or edge sections) which cooperate with each other to interposedly hold the end of the connection conductor therebetween and bite at a distal end thereof into an end of the connection conductor when drawing force is applied to the connection conductor. The distal end of each of the holding elements is formed Into the same configuration while being inclined at substantially the same angle. The holding elements in each pair opposite to each other are so arranged that a distance between the distal ends is smaller than a diameter of the connection conductor. Thus, when the connection conductor is inserted through the terminal fitment, the four holding elements are forcedly enlarged to interposedly hold the end of the connection conductor together. Then, when drawing force is applied to the connection conductor, the four holding elements are caused to bite at an edge thereof Into the end of the connection conductor, to thereby keep the connection conductor from being released from the terminal fitment.

Unfortunately, in the conventional terminal fitment used for the electric component unit, it is required to concurrently enlarge the ends of the four holding elements when the connection conductor is inserted through the terminal fitment. Insertion of the connection conductor through the terminal fitment by manual operation Is deteriorated in workability when force applied to the connection conductor during the insertion is increased. Also, when insertion of the connection conductor Is carried out by means of an automatic inserting machine, it is required to adjust force for the insertion every time when the connection conductor is varied in diameter.

A terminal fitment of a single kind is often used in common for connection conductors difference in diameter in order to meet a demand of a user of an electric component unit and/or in view of a design of the unit. However, in each of the conventional terminal fitments, a distance between the distal ends of the holding elements in each pair opposite to each other is determined depending on a diameter of a connection conductor which is intended to be inserted through the terminal fitment. Thus, when a connection conductor which has a diameter increased as compared with predetermined one is inserted into the terminal fitment, an operator highly tends to have a sense of incompatibility due to a difference in force required for the insertion; thus, the operator often regards the connection conductor inserted and/or the terminal fitment as defective although they are actually non-defective, leading to a deterioration in yields. The connection conductor and/or terminal fitment regarded as defective would be reinspected by means of X-rays or the like, however, this leads to an extensive deterioration in operational efficiency.

Moreover, the conventional terminal fitments each cause a problem that application of force of pivotally moving a connection conductor about its central line to the connection conductor after insertion thereof through the terminal fitment causes the connection conductor to be cut by an edge of the distal end of each of the holding elements.

SUMMARY OF THE INVENTION

The present invention has been made in view of the foregoing disadvantages of the prior art.

Accordingly, it is an object of the present invention to provide an electric component unit including a terminal fitment which is capable of adjusting force of inserting a connection conductor through the terminal fitment.

It is another object of the present invention to provide an electric component unit including a terminal fitment which is capable of being accommodated to insertion of plural types of connection conductors different in diameter therethrough while keeping an operator from feeling a difference in force of inserting the connection conductors therethrough.

It is a further object of the present invention to provide an electric component unit including a terminal fitment which is capable of sufficiently withstanding pivotal force applied thereto, to thereby be substantially prevented from being cut.

In accordance with the present invention, an electric component unit Is provided. The electric component unit includes an insulating casing formed with a through-hole through which a connection conductor is inserted at an end thereof into the insulating casing, a terminal fitment arranged in the insulating casing so as to interposedly hold the end of the connection conductor inserted through the through-hole into the insulating casing, and an electric component arranged in the insulating casing and electrically connected to the terminal fitment. The terminal fitment includes a conductor holding section for holding the end of the connection conductor. The conductor holding section includes a body portion formed with a conductor end inserting hole through which the end of the connection conductor is inserted and four holding elements each having a base integrally connected to an edge of the conductor end inserting hole and arranged in a manner to be spaced from each other at predetermined intervals in a circumferential direction thereof. The holding elements each include a distal portion arranged so as to be inclined in a direction of Insertion of the connection conductor through the conductor end inserting hole when the end of the connection conductor inserted forces it in the direction of insertion of the connection conductor and so as to bite into the end of the connection conductor when drawing force is applied to the connection conductor.

The terminal fitment is preferably made by subjecting a metal plate to machining. When the electric component electrically connected to the terminal fitment is a circuit board, electrical connection between the terminal fitment and an electrode on the circuit board may be carried out in any desired manner. For example, it may be attained by means of a conductive rubber member or by integrally providing the terminal fitment with a contact terminal contacted with the electrode on the circuit board as disclosed in U.S. Pat. No. 5,546,280. Alternatively, it may be carried out by means of a conductive coiled spring as disclosed in Japanese Patent Application Laid-Open Publication No. 189316/1998.

In the present invention, two of the holding elements are so arranged that the distal portions thereof are opposite to each other with the end of the connection conductor being interposed therebetween and contacted with the end of the connection conductor. Also, the remaining two of the holding elements are so arranged that the distal portions thereof are positioned forwardly or rearwardly in a longitudinal direction of the connection conductor based on a position at which the two holding elements are contacted with the end of the connection conductor while being contacted with the end of the connection conductor and interposing the end of the connection conductor therebetween.

Such construction permits positions at which the holding elements are contacted with the connection conductor to be dispersed in a longitudinal direction of the connection conductor, to thereby significantly reduce resistance between the connection conductor and the terminal fitment during the insertion as compared with the prior art wherein the holding elements are contacted with the connection conductor at a single position in the longitudinal direction of the connection conductor, resulting in the insertion being facilitated. Thus, suitable adjustment of lengths and widths of two pairs of holding elements and a distance between each pair of holding elements permits force required for inserting the connection conductor through the terminal fitment to be adjusted as desired, to thereby significantly restrain an operator from having a sense of incompatibility during the insertion. Further, the present invention may be constructed so as to permit the connection conductor to be held at two positions defined forwardly and rearwardly in the longitudinal direction of the connection conductor. Such construction prevents the four holding elements from biting into only a portion of the connection conductor defined on a single circumferential line thereof when the connection conductor inserted Is revolved, resulting In preventing cutting of the connection conductor. The holding elements each preferably include a trunk portion of a substantially rectangular shape and the above-described distal portion formed into a semicircular shape.

The terminal fitments are preferably arranged so as to be spaced from each other at angular intervals of about 90 degrees in a circumferential direction of the terminal fitment. Such arrangement permits the two holding fitments in each pair to be fully opposite to each other with the connection conductor being interposed therebetween, to thereby ensure positive holding of the connection conductor. The two holding fitments in each pair may be formed into the same configuration. This permits each two holding elements to exhibit substantially the same strength, so that the connection conductor may be smoothly moved from the forward two holding elements to the rearward ones.

In a preferred embodiment of the present invention, the distal portion of each of the holding elements is formed into a forwardly projected arcuate shape. This effectively prevents the distal portion of each of the holding elements from excessively biting into the end of the connection conductor when revolving force is applied to the connection conductor, to thereby prevent cutting of the connection conductor.

In a preferred embodiment of the present invention, the holding elements each have a length and an angle with respect to the body portion determined so that a distance between the two holding elements and that between the remaining two holding elements prior to insertion of the end of the connection conductor through the terminal fitment are substantially equal to each other. Thus, the terminal fitment may be applied to plural kinds of connection conductors which are different in diameter from each other and each of which has a diameter larger than a distance between the distal portions of the holding elements opposite to each other.

In a preferred embodiment of the present invention, the holding elements are so formed that the two holding elements are arranged opposite to each other while interposing the end of the connection conductor therebetween and being contacted with the end of the connection conductor at a position forward of a position at which the remaining two holding elements are contacted with the end of the connection conductor. Also, the holding elements are also formed so that holding force by which the distal portions of the two holding elements hold the end of the connection conductor together is larger than that by which the distal portions of the remaining two holding elements hold the end of the connection conductor together. More specifically, the trunk portion of each of the forward two holding elements is formed into a width larger than that of the rearward two holding elements and the former is formed into a length smaller than the latter. Such construction reduces a difference between force required for expanding the forward two holding elements and that for expanding the rearward two holding elements, to thereby substantially prevent an operator from having a sense of incompatibility during operation of inserting the connection conductor through the terminal fitment.

BRIEF DESCRIPTION OF THE DRAWINGS

These and other objects and many of the attendant advantages of the present invention will be readily appreciated as the same becomes better understood by reference to the following detailed description when considered in connection with the accompanying drawings: wherein.

DETAILED DESCRIPTION OF THE PREFERRED EMBODIMENT

Now, an electric component unit according to the present invention will be described hereinafter with reference to the accompanying drawings.

Figure 1:
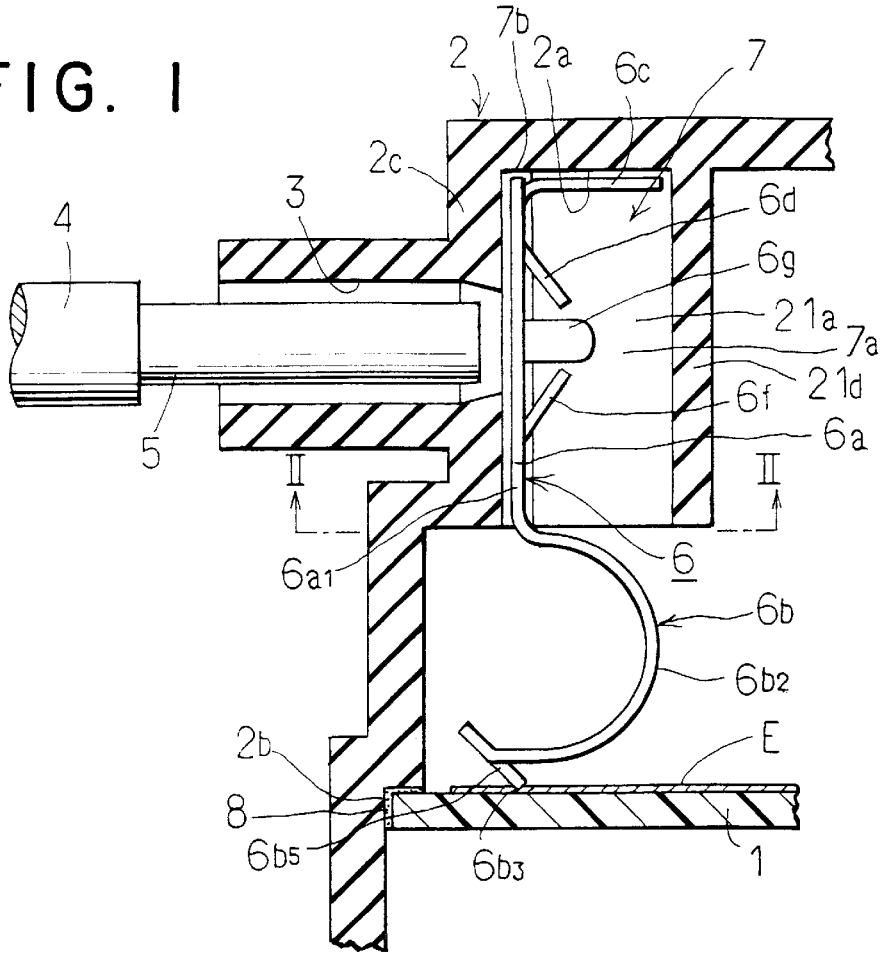
FIG. 1 is a fragmentary vertical sectional view showing an essential part of an embodiment of an electric component unit according to the present invention.
Figure 2:
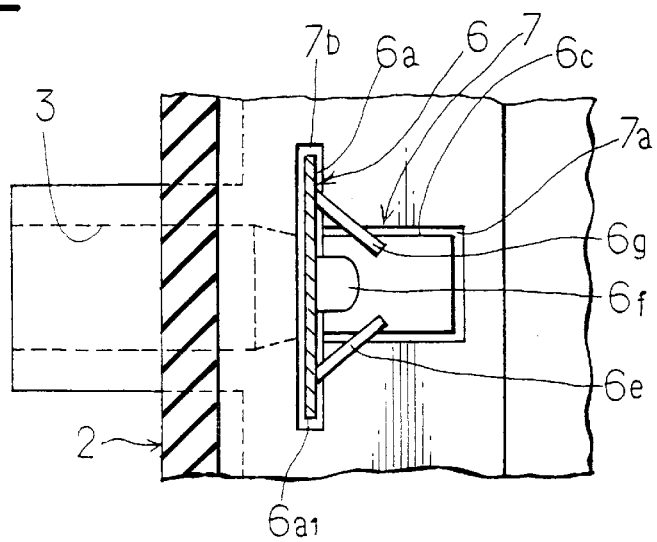
FIG. 2 is a sectional view taken along line II—II of FIG. 1.

Referring first to FIGS. 1 and 2, an embodiment of an electric component unit according to the present invention is illustrated, which is embodied in the form of a high-voltage variable resistor. The high-voltage variable resistor includes a circuit board 1 constituted of a ceramic substrate and a variable resistance circuit patterns formed on the ceramic substrate and including a plurality of electrodes and variable resistances. The circuit board 1 constitutes an electric component electrically connected to a terminal fitment 6 described hereinafter. In FIG. 1, of the plural electrodes, only one electrode E electrically connected to the terminal fitment 6 is shown for the sake of brevity. Reference numeral 2 designates an insulating casing which is formed so as to be open on one side thereof, resulting in being provided with an opening, which is formed with a step 2*b* acting as a rib. The circuit board 1 is joined at an outer periphery thereof to the rib 2*b* by means of an epoxy adhesive 8. Such arrangement permits the insulating casing 2 to receive the circuit board 1 therein so as to define a space between a front surface of the circuit board 1 and an inner surface 2*a* of the insulating casing 2. The insulating casing 2 includes a peripheral wall 2*c* arranged so as to surround an outer periphery of the circuit board 1. The peripheral wall 2*c* of the insulating casing 2 is formed with a through-hole 3 through which a core or connection conductor 5 of a lead wire 4 is guided at an end thereof into the insulating casing 2. The insulating casing 2 is provided therein with the terminal fitment 6 briefly described above in a manner to be interposedly arranged between the front surface of the circuit board 1 and the inner surface 2*a* of the insulating casing 2. More specifically, the terminal fitment 6 includes a connection conductor holding section 6*a* which is fitted in a terminal fitment fit section 7. The terminal fitment fit section 7 is formed with a connection conductor inserting space 7*a* communicating with the through-hole 3 formed through the peripheral wall of the insulating casing 2. The connection conductor inserting space 7*a* has an opening formed so as to be open on a side of the opening of the casing 2 or facing the circuit board 1. The terminal fitment fit section 7 is formed with a fit groove 7*b* in a manner to be perpendicular to the connection conductor inserting space 7*a*. The fit groove 7*b* is fitted therein with a flat plate-like body portion 6*a*1 of the conductor holding section 6*a* of the terminal fitment 6.

Figure 3A:
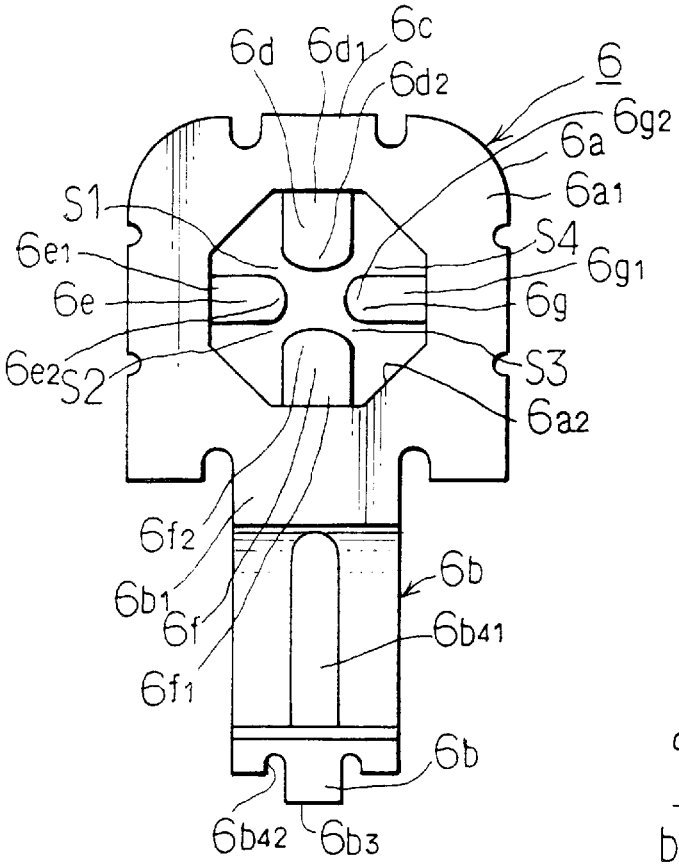
FIG. 3A is a front elevation view showing a terminal fitment incorporated in the electric component unit of FIG. 1 by way of example.
Figure 3B:
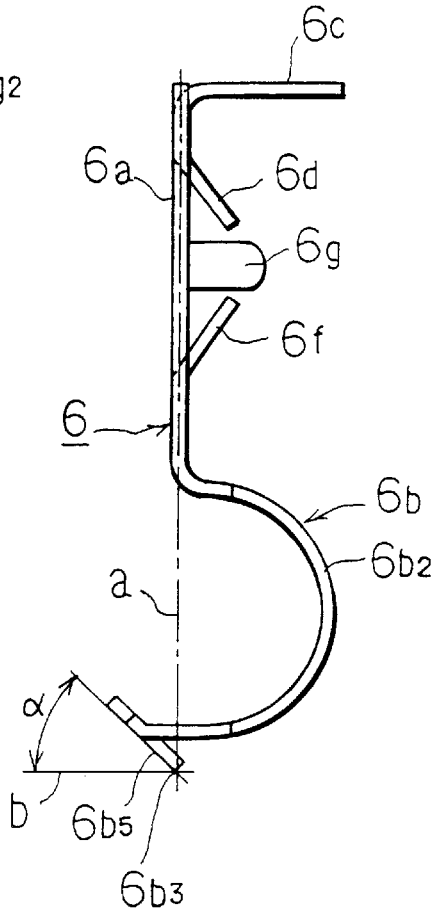
FIG. 3B and 3C are a right side elevation view and a bottom view of the terminal fitment shown in FIG. 3A, respectively.
Figure 3C:
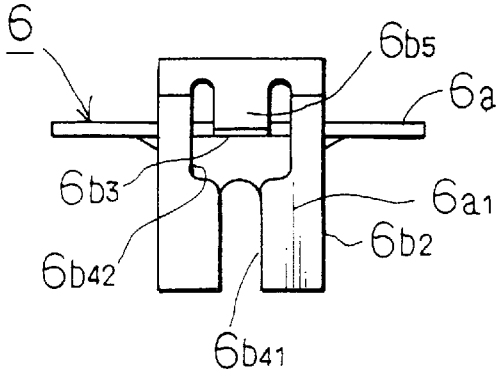

Now, the terminal fitment 6 will be described with reference to FIGS. 3A to 3C, which are a front elevation view, a right-side elevation view and a bottom view of the terminal fitment 6, respectively. The terminal fitment 6 includes the above-described conductor holding section 6*a* for interposedly holding the end of the connection conductor 5, a contact terminal section 6*b* integrally provided on the conductor holding section 6*a* and a plate-like section 6*c* extending in a direction perpendicular to the flat plate-like body portion 6*a*1 of the conductor holding section 6*a* on a side opposite to that on which the contact terminal section 6*b* is arranged.

The terminal fitment 6 may be made by subjecting a conductive plate made of metal such as stainless steel, bronze or the like to machining such as pressing, bending or the like. The terminal fitment 6 is constructed so as to electrically connect the end of the connection conductor 5 to the electrode E without soldering. The conductive metal plate preferably exhibits elasticity to some degree when it is subject to bending. Thus, for example, a SUS 301 stainless steel plate of 0.1 to 0.4 mm in thickness, a phosphor bronze plate of 0.2 to 0.5 mm in thickness or the like may be used for this purpose.

The flat plate-like body portion 6*a*1 of the connection conductor holding section 6*a* is formed into a substantially rectangular shape. The body portion 6*a*1 is formed at a central portion thereof with a conductor end inserting hole 6*a*2 by punching. The conductor end inserting hole 6*a*2 of the body portion 6*a*1 has four holding elements 6*d* to 6*g*, connected to an inner periphery thereof. The holding elements 6*d* to 6*g* are arranged so as to be spaced from each other at angular intervals of about 90 degrees in a peripheral direction of the hole 6*a*2. Also, the holding elements 6*d* to 6*g* are constructed so as to be inclined in a direction of insertion of the connection conductor 5 when they are forced in the direction of insertion of the connection conductor 5 by the end of the connection conductor 5 inserted through the conductor end inserting hole 6*a*2. Also, the holding elements 6*d* to 6*g* are constructed so as to bite into the end of the connection conductor 5 when drawing force is applied to the end of the connection conductor 5.

Figure 4A:
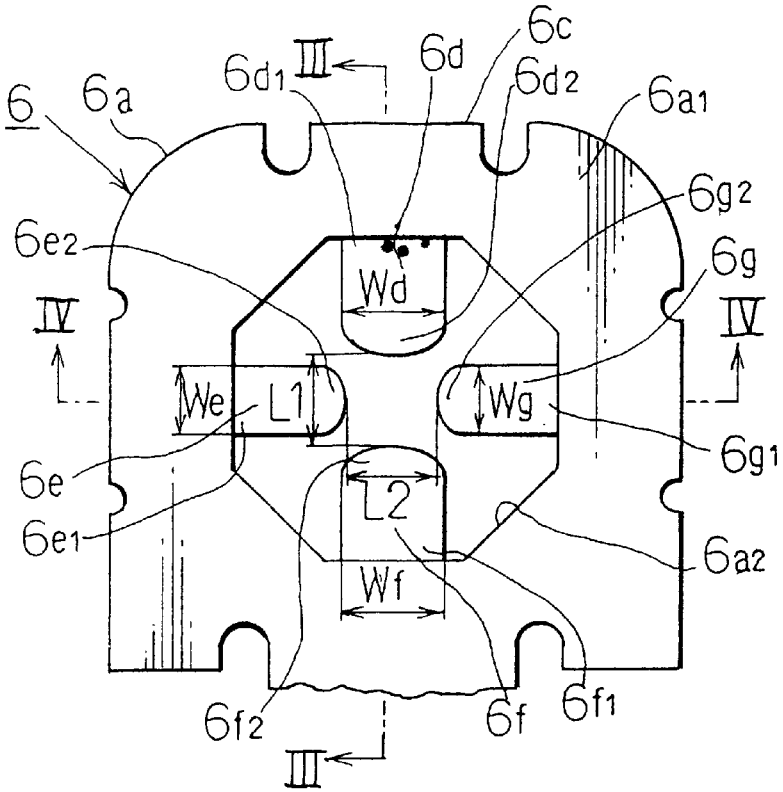
FIG. 4A is an enlarged view showing a conductor holding section of the terminal fitment of FIGS. 3A to 3C.
Figure 4B:
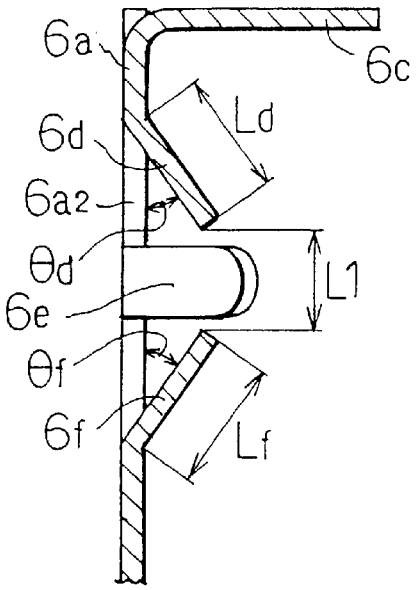
FIG. 4B is a sectional view taken along line III—III of FIG. 4A.
Figure 4C:
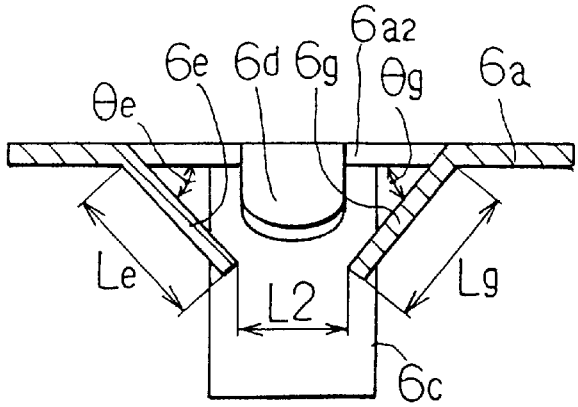
FIG. 4C is a sectional view taken along line IV—IV of FIG. 4A.

Now, the holding elements 6*d* to 6*g* will be described more detailedly with reference to FIGS. 4A to 4C, which are enlarged views of FIGS. 3A to 3C, respectively, wherein dimensions of the holding elements 6*d* to 6*g* and angles thereof are emphasized to some degree. The holding elements 6*d* to 6*g* include trunk portions 6*d*1 to 6*g*1 of a substantially rectangular shape and distal portions 6*d*2 to 6*g*2 of a semicircular shape, respectively. The trunk portions 6*d*1 and 6*f*1 of the two holding elements 6*d* and 6*f* arranged opposite to each other in a vertical direction in FIGS. 2 and 3 are formed into widths Wd and Wf larger than widths We and Wg of the remaining two trunks 6*e*1 and 6*g*1 of the holding elements 6*e* and 6*g* opposite to each other in a lateral direction. Also, the holding elements 6*d* and 6*f* have lengths Ld and Lf formed to be smaller than lengths Le and Lg of the holding elements 6*e* and 6*g*. In the illustrated embodiment, the widths Wd and Wf are set to be the same, the widths We and Wg are the same, the lengths Ld and Lf are the same, and the lengths Le and Lg are the same (Wd=Wf, We=Wg, Ld=Lf and Le=Lg). Thus, it will be noted that the holding elements 6*d* and 6*f* are of the same configuration and the holding elements 6*e* and 6*g* are of the same configuration.

Further, the holding elements 6*d* to 6*g* are inclined in such a manner that angles θd and θf of inclination of the holding elements 6*d* and 6*f* with respect to a plane of the body portion 6*a*1 and angles θe and θg of inclination of the holding elements 6*e* and 6*g* with respect to a plane of the body 6*a*1 are determined so as to render a distance L1 between the distal portions 6*d*2 and 6*f*2 of the holding elements 6*d* and 6*f* (and more strictly a distance between biting edges of the distal portions) and a distance L2 between the distal portions 6*e*2 and 6*g*2 of the holding elements 6*e* and 6*g* (and more strictly a distance between biting edges of the distal portions) substantially equal to each other. The distances L1 and L2 each are set to be smaller than a diameter of a connection conductor having the smallest diameter of plural kinds of connection conductors intended to be held.

The above-described dimensional and angular relationship permits the holding elements 6*d* and 6*f* to be forwardly contacted with the connection conductor 5 inserted through the terminal fitment 6 and the holding elements 6*e* and 6*g* to be rearwardly contacted therewith, as viewed from a side of the body portion 6*a*1 of the terminal fitment 6. Moreover, the holding elements 6*d* to 6*g* are so constructed that holding force by which the distal portions 6*d*2 and 6*f*2 of the holding elements 6*d* and 6*f* interposedly hold the end of the connection conductor 5 is set to be larger than that by which the distal portions 6*e*2 and 6*g*2 of the remaining holding elements 6*e* and 6*g* hold the connection conductor together.

In the illustrated embodiment, the distal portions 6*d*2 to 6*g*2 of the holding elements 6*d* to 6*g* each are formed into a forwardly projected arcuate shape. Such a configuration of the holding elements prevents the distal portions 6*d*2 to 6*g*2 of the holding elements 6*d* to 6*g* from excessively biting into the end of the connection conductor 5 when the connection conductor 5 is revolved about a central line of the connection conductor 5 defined in a longitudinal direction thereof, resulting in substantially preventing cutting of the connection conductor 5 by the distal portions 6*d*2 to 6*g*2.

The contact terminal section 6*b* includes an elongated plate-like portion 6*b*1 contiguous to the flat plate-like body portion 6*a*1 and connected at a base thereof to the body portion 6*a*1. The plate-like portion 6*b*1 is provided with a curved portion 6*b*2, which is formed by machining such as pressing, bending or the like, and a contact portion 6*b*3. The curved portion 6*b*2 is formed with a slit 6*b*41 so as to extend along an elongated plate-like portion 6*b*6. The elongated plate-like portion 6*b*1 is formed at a distal end thereof with a punched hole 6*b*42 for forming a biting element 6*b*5 which has a base positioned on a side of the distal end of the elongated plate-like portion 6*b*1 is formed. The biting element 6*b*5 is arranged in such a manner that a distal end thereof is positioned on a side of the curved portion 6*b*2 as compared with the base thereof.

In the illustrated embodiment, the holding elements may be formed into any desired configuration. Also, in the illustrated embodiment, the terminal fitment is integrally provided with the contact terminal section 6*b*. However, it is not necessarily required to provide the terminal fitment with the contact terminal section. The terminal fitment may be connected to the electrode E2 by means of a conductive rubber member other than the contact terminal section. Further, the illustrated embodiment is applied to a high-voltage variable resistor. However, of course the present invention may be applied to an electric component unit of any other type so long as it requires connection of a connection conductor without soldering.

As can be seen form the foregoing, in the present invention, the terminal fitment is so constructed that two of the four holding elements hold an end of a connection conductor at a position defined forwardly in a longitudinal direction of the connection conductor and the other two holding elements hold it at a position defined rearwardly in the longitudinal direction. Such construction permits contact between the holding elements and the connection conductor to be carried out in a manner to be positionally dispersed in the longitudinal direction of the connection conductor, resulting in reducing resistance during insertion of the connection conductor through the terminal fitment as compared with the prior art wherein the four holding elements are concurrently contacted with the connection conductor at a single position, so that the insertion may be highly facilitated.

Also, in the present invention, suitable adjustment of lengths and widths of two pairs of holding elements and a distance between the holding elements in each pair permits force required to insert the connection conductor through the terminal fitment to be adjusted as desired, to thereby significantly restrain an operator from having a sense of incompatibility during the insertion.

Further, the present invention is constructed so as to permit the connection conductor to be held at two positions defined forwardly and rearwardly in the longitudinal direction of the connection conductor. Such construction prevents the four holding elements from biting into only a portion of the connection conductor defined on a single circumferential line thereof when the connection conductor inserted is revolved, resulting in preventing cutting of the connection conductor.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An electric component unit comprising:

an insulating casing formed with a through-hole through which a connection conductor is inserted at an end thereof into said insulating casing;

a terminal fitment arranged in said insulating casing so as to interposedly hold the end of the connection conductor inserted through said through-hole into said insulating casing; and an electric component arranged in said insulating casing and electrically connected to the terminal fitment;

said terminal fitment including a conductor holding section for holding the end of the connection conductor;

said conductor holding section including a body portion formed with a conductor end inserting hole through which the end of the connection conductor is inserted and four holding elements each having a base integrally connected to an edge of said conductor end inserting hole and arranged in a manner to be spaced from each other at predetermined intervals in a circumferential direction thereof;

said holding elements each including a distal portion arranged so as to be inclined in a direction of insertion of the connection conductor through said conductor end inserting hole when the end of the connection conductor inserted forces it in the direction of insertion of the connection conductor and so as to bite into the end of the connection conductor when drawing force is applied to the connection conductor;

two of said holding elements being so arranged that said distal portions thereof are opposite to each other with the end of the connection conductor being interposed therebetween and contacted with the end of the connection conductor;

the remaining two of said holding elements being so arranged that said distal portions thereof are positioned forwardly or rearwardly in a longitudinal direction of the connection conductor based on a position at which said two holding elements are contacted with the end of the connection conductor while being contacted with the end of the connection conductor and interposing the end of the connection conductor therebetween.

2. An electric component unit as defined in claim 1, wherein said distal portion of each of said holding elements is formed into a forwardly projected arcuate shape.

3. An electric component unit as defined in claim 2, wherein said holding elements each have a length and an angle with respect to said body portion determined so that a distance between said two holding elements and that between said remaining two holding elements prior to insertion of the end of the connection conductor through said terminal fitment are substantially equal to each other.

4. An electric component unit as defined in claim 3, wherein said holding elements are so formed that said two holding elements are arranged opposite to each other while interposing the end of the connection conductor therebetween and being contacted with the end of the connection conductor at a position forward of a position at which said remaining two holding elements are contacted with the end of the connection conductor; and said holding elements are also formed so that holding force by which said distal portions of said two holding elements hold the end of the connection conductor together is larger than that by which said distal portions of said remaining two holding elements hold the end of the connection conductor together.

5. An electric component unit as defined in claim 4, wherein said holding elements each include a trunk portion of a substantially rectangular shape and said distal portion of a substantially semi-circular shape;

said trunk portion of each of said two holding elements being formed into a width larger than that of said remaining two holding elements; and said two holding elements are formed into a length smaller than that of said remaining two holding elements.

6. An electric component unit comprising:

an insulating casing formed with a through-hole through which a connection conductor is inserted at an end thereof into said insulating casing;

a terminal fitment arranged in said insulating casing so as to interposedly hold the end of the connection conductor inserted through said through-hole into said insulating casing; and an electric component arranged in said insulating casing and electrically connected to the terminal fitment;

said terminal fitment being integrally formed by subjecting a metal plate to machining;

said terminal fitment including a conductor holding section for holding the end of the connection conductor;

said conductor holding section including a body portion formed with a conductor end inserting hole through which the end of the connection conductor is inserted and four holding elements each having a base integrally connected to an edge of said conductor end inserting hole and arranged in a manner to be spaced from each other at angular intervals of about 90 degrees in a circumferential direction thereof;

said holding elements each including a distal portion arranged so as to be inclined in a direction of insertion of the connection conductor through said conductor end inserting hole when the end of the connection conductor inserted forces it in the direction of insertion of the connection conductor and so as to bite into the end of the connection conductor when drawing force is applied to the connection conductor;

two of said holding elements being formed into an identical configuration which permits said distal portions thereof to be opposite to each other with the end of the connection conductor being interposed therebetween and contacted with the end of the connection conductor;

the remaining two of said holding elements being formed into an identical configuration which permits said distal portions thereof to be positioned forwardly or rearwardly in a longitudinal direction of the connection conductor based on a position at which said two holding elements are contacted with the end of the connection conductor while being contacted with the end of the connection conductor and interposing the end of the connection conductor therebetween.

7. An electric component unit as defined in claim 6, wherein said distal portion of each of said holding elements is formed into a forwardly projected arcuate shape.

8. An electric component unit as defined in claim 7, wherein said holding elements each have a length and an angle with respect to said body portion determined so that a distance between said two holding elements and that between said remaining two holding elements prior to insertion of the end of the connection conductor through said terminal fitment are substantially equal to each other.

9. An electric component unit as defined in claim 8, wherein said holding elements are so formed that said two holding elements are arranged opposite to each other while interposing the end of the connection conductor therebetween and being contacted with the end of the connection conductor at a position forward of a position at which said remaining two holding elements are contacted with the end of the connection conductor; and said holding elements are also formed so that holding force by which said distal portions of said two holding elements hold the end of the connection conductor together is larger than that by which said distal portions of said remaining two holding elements hold the end of the connection conductor together.

10. An electric component unit as defined in claim 9, wherein said holding elements each include a trunk portion of a substantially rectangular shape and said distal portion of a substantially semi-circular shape;

said trunk portion of each of said two holding elements being formed into a width larger than that of said remaining two holding elements; and said two holding elements are formed into a length smaller than that of said remaining two holding elements.

* * * * *